US008328586B2

(12) United States Patent
Bies et al.

(10) Patent No.: US 8,328,586 B2
(45) Date of Patent: Dec. 11, 2012

(54) ACTUATING DEVICE FOR AN ELECTRICAL CONNECTION TERMINAL

(75) Inventors: Henryk Bies, Sondershausen (DE); Stephan Gassauer, Ilfeld (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 13/075,610

(22) Filed: Mar. 30, 2011

(65) Prior Publication Data

US 2011/0250775 A1 Oct. 13, 2011

(30) Foreign Application Priority Data

Apr. 7, 2010 (DE) ..... 10 2010 014 143

(51) Int. Cl.
*H01R 4/28* (2006.01)

(52) U.S. Cl. ..... 439/725

(58) Field of Classification Search ..... 439/725, 439/268, 441, 438, 828
See application file for complete search history.

(56) References Cited

U.S. PATENT DOCUMENTS

| | | | | |
|---|---|---|---|---|
| 4,728,295 | A * | 3/1988 | Henrici et al. | 439/84 |
| 4,759,726 | A * | 7/1988 | Naylor et al. | 439/441 |
| 4,895,526 | A * | 1/1990 | Henrici et al. | 439/108 |
| 5,083,947 | A * | 1/1992 | Dominique et al. | 439/725 |
| 5,902,142 | A * | 5/1999 | Kondo et al. | 439/267 |
| 6,250,950 | B1 * | 6/2001 | Pallai | 439/441 |
| 6,783,385 | B2 * | 8/2004 | Rudy | 439/438 |
| 7,354,319 | B2 * | 4/2008 | Camino et al. | 439/828 |
| 7,507,107 | B2 * | 3/2009 | Tuerschmann et al. | 439/441 |
| 7,789,695 | B2 * | 9/2010 | Radle | 439/402 |

FOREIGN PATENT DOCUMENTS

| | | |
|---|---|---|
| DE | 19735835 A1 | 2/1999 |
| EP | 1 182 750 A2 | 2/2002 |
| ES | 2 159 247 | 8/1999 |

* cited by examiner

*Primary Examiner* — Alexander Gilman
(74) *Attorney, Agent, or Firm* — Whitham Curtis Christofferson & Cook, PC

(57) ABSTRACT

Actuating device for an electrical connection terminal, wherein the electrical connection terminal comprises a contact frame, arranged in a housing made of insulating material, with a conductor terminal connection for an electrical conductor, and the actuating device comprises an actuating element in the form of a pusher which is integrally connected to the housing made of insulating material, and wherein the conductor terminal connection is formed on the contact frame by at least one spring element, the free end of which forms a clamping edge which is directed toward the electrical conductor and to which a clamping force is applied, and the conductor terminal connection can be opened by action of the pusher on the at least one spring element by a force being applied to the spring element by the pusher counter to the clamping force. According to the invention, the pusher consists of a pusher arm, wherein the pusher arm is connected with one of its ends to the housing made of insulating material, and wherein the pusher arm extends along at least a partial section of two upper surfaces of the housing made of insulating material which are arranged at an angle to each other.

12 Claims, 5 Drawing Sheets

ACTUATING DEVICE FOR AN ELECTRICAL CONNECTION TERMINAL

The invention relates to an actuating device for an electrical connection terminal, wherein the electrical connection terminal comprises a contact frame, arranged in a housing made of insulating material, with a conductor terminal connection for an electrical conductor, and the actuating device comprises an actuating element in the form of a pusher which is integrally connected to the housing made of insulating material, and wherein the conductor terminal connection is formed on the contact frame by at least one spring element, the free end of which forms a clamping edge which is directed toward the electrical conductor and to which a clamping force is applied, and the conductor terminal connection can be opened by action of the pusher on the at least one spring element by a force being applied to the spring element by the pusher counter to the clamping force.

PRIOR ART

The document ES 2 159 247 A1 discloses an electrical connection terminal having a housing for a pluggable electrical conductor with a spring clamping contact. A lever-like pusher is integrally formed on the upper side of the housing. A pin is provided on the pusher, engages in a recess of the housing and in a recess of a contact insert, and, when the pusher is actuated, acts on the clamping spring to release the clamping contact. In order to achieve an effective lever arm, the pusher overall has a large and complex configuration. A comparable design is disclosed in the document EP 1 182 750 A2.

OBJECT OF THE INVENTION

The object of the invention is to provide an electrical connection terminal for the connection of an electrical conductor which ensures secure clamping of the electrical conductor and at the same time is simple in construction.

SUMMARY OF THE INVENTION

The invention is achieved according to the invention by the features of claim 1. According to this, it is provided for an actuating device for an electrical connection terminal, wherein the electrical connection terminal comprises a contact frame, arranged in a housing made of insulating material, with a conductor terminal connection for an electrical conductor, and the actuating device comprises an actuating element in the form of a pusher which is integrally connected to the housing made of insulating material, and wherein the conductor terminal connection is formed on the contact frame by at least one spring element, the free end of which forms a clamping edge which is directed toward the electrical conductor and to which a clamping force is applied, and the conductor terminal connection can be opened by action of the pusher on the at least one spring element by a force being applied to the spring element by the pusher counter to the clamping force, that according to the invention the pusher consists of a pusher arm, wherein the pusher arm is connected with one of its ends to the housing made of insulating material, and wherein the pusher arm extends along at least a partial section of two upper surfaces of the housing made of insulating material which are arranged at an angle to each other.

The design according to the invention of the pusher, which thus has an angular form, allows a relatively long effective pusher arm with a correspondingly long lever arm, which is particularly advantageous where structural space is limited or where electrical connection terminals are very small with small housings made of insulating material. In particular in the case of miniaturized connection terminals, it is only made possible by the design of the pusher according to the invention to provide an effective pusher for actuating a contact frame.

In a preferred embodiment, the two upper surfaces which are arranged at an angle to each other are arranged at least almost perpendicularly to each other. The pusher arm is thus preferably formed from a first pusher arm part which matches the course of a rear side of the housing, and a second pusher arm part which matches the course of an upper surface of the housing. Furthermore, the pusher arm is thus preferably arranged in a recess of the housing made of insulating material.

In a particularly advantageous embodiment, the pusher arm has an actuating surface with a trough-like recess, so that it is made possible for an actuating tool to be applied to it easily, so that the pusher can be actuated reliably.

The pusher arm can preferably be deformed resiliently so that a simple movement or deflection of the pusher can be ensured with minimal structural complexity.

In a preferred embodiment, the spring element takes the form of at least one leaf spring or a spring leg, so that in the preferred design of the contact frame in the manner of a channel, the contact frame has on each side wall, in order to form a conductor terminal connection, in each case at least one leaf spring, in the manner of a tongue stamped from a flat material, which is bent out of the plane of the flat material, in such a way that the free end of the leaf spring forms a clamping edge directed toward the electrical conductor. The electrical connection terminal is thus formed from just two components, the housing made of insulating material with an integrated pusher as well as a one-part contact frame, so that a simple structure and simple assembly can be ensured at low cost.

A lead-in sloping face directed toward the outside of the electrical connection terminal is preferably in each case integrally formed on the leaf springs, which lead-in sloping faces are flared out relative to each other in a funnel shape. The pusher can thus easily be pushed in between the leaf springs in order to open the terminal connection of the electrical conductor by the leaf springs being pushed apart. To this end, the pusher preferably has a corresponding wedge-shaped pusher surface which is formed at the end of the pusher arm remote from the end connected to the housing made from insulating material.

In the assembled state of the electrical connection terminal, in which the contact frame is inserted in the housing made of insulating material, the pusher arm is subject to pretensioning so that the pusher arm projects above the upper surface of the upper side of the housing. Because the pusher arm is subject to pretensioning in the unactuated state, the tension which is applied to the pusher arm can be kept small. The value of the pretensioning is relatively small as the deflection of the pusher arm in the unactuated state is also relatively small. The deflection of the pusher arm in the actuated position into the housing made of insulating material is also not significantly much greater than in the unactuated state, so that the tensions to which the pusher arm is subject can overall be kept small. The values of the tension within the pusher or the pusher arm, which are kept low, contribute to it being possible for the pusher and thus the housing made of insulating material too to be kept small.

In order to effectively avoid damage to the at least one spring element and/or the pusher, and in particular fracturing, in a preferred embodiment an overload protection is provided for this purpose. The deflection of the spring element in the form of a leaf spring can here advantageously be limited by side walls and/or partition walls of the housing made of insulating material. Moreover, the deflection of the pusher arm of the pusher is advantageously limited by the pusher arm bearing against at least one spring element in the form of a leaf spring. These embodiments permit an overload protection without any essential adaptations of the connection terminal and are thus cost-effective.

DESCRIPTION OF THE DRAWINGS

The invention is described in more detail below with reference to an exemplary embodiment illustrated in the drawings, in which.

DESCRIPTION OF THE PREFERRED EMBODIMENT

Figure 1:
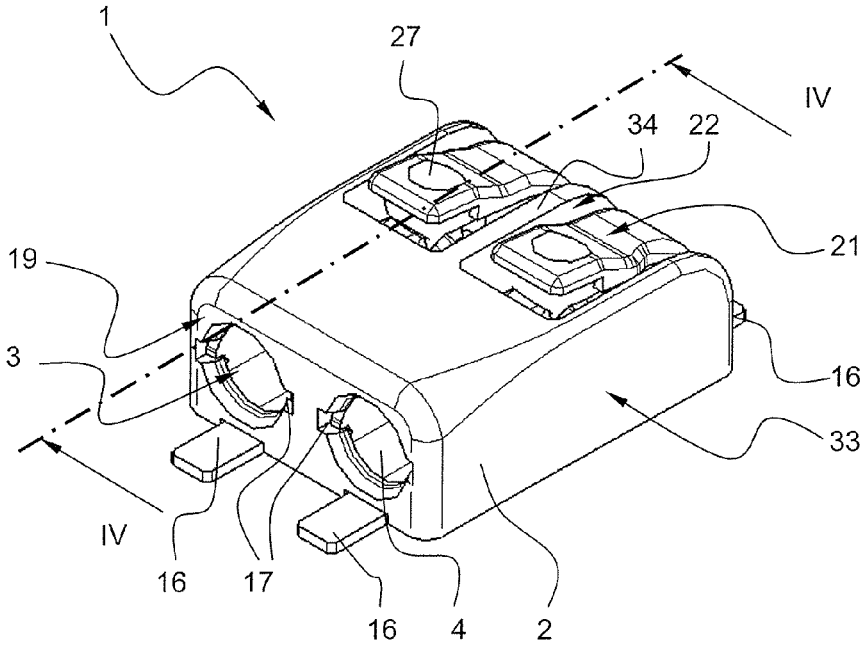
FIG. 1 shows an assembled connection terminal according to the invention in a perspective view.
Figure 4:
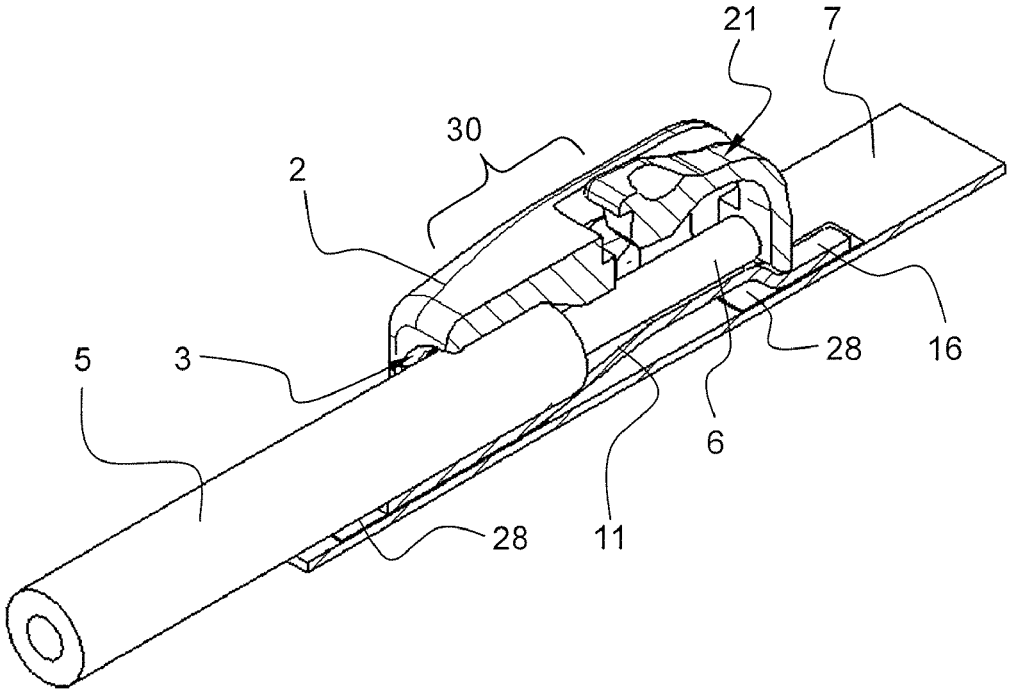
FIG. 4 shows a perspective cross-sectional view of the connection terminal according to the invention arranged on a printed circuit board, with a plugged-in electrical conductor.

FIG. 1 shows an electrical connection terminal 1 according to the invention with a housing 2 made of insulating material in which a metal contact frame 4 is accommodated. The housing 2 made of insulating material has at one end side 19 at least one conductor introduction opening 3 for plugging in an electrical conductor 5 (FIG. 4). In the exemplary embodiment shown, the connection terminal 1 has a two-pole design with in each case one conductor introduction opening 3 and one contact frame 4 per pole. The connection terminal can, however, also have any other desired number of poles.

Figure 2:
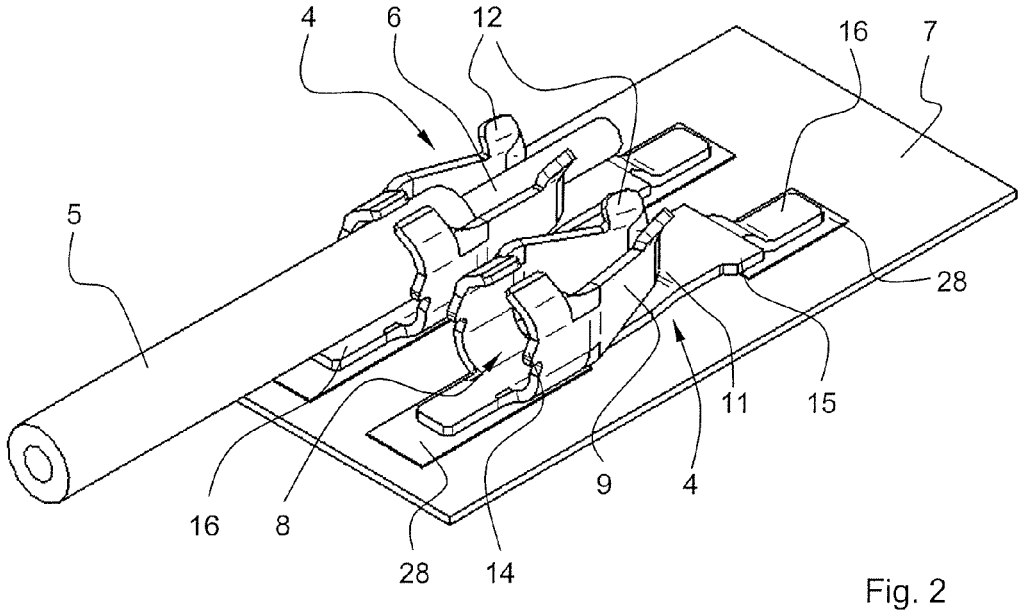
FIG. 2 shows a connection terminal according to the invention arranged on a printed circuit board, with a plugged-in conductor and no housing made of insulating material.

Also visible in FIG. 1 are connection regions 16 of the contact frame 4 which contact corresponding contact portions 28, for example conductor tracks, of a printed circuit board 7 (FIG. 2). The connection regions 16 are here connected to the contact portions 28 in particular via a solder connection (SMD solder connection), but a plug-in connection is also conceivable. The contact frame 4 held on the printed circuit board 7 can be seen in FIG. 2. The housing made of insulating material has been omitted in this drawing so that the connection of the electrical conductor 5 to the contact frame 4 can be seen. The electrical conductor 5 is introduced through a channel entrance 8, which is bent into an annular shape and is designed such that it is at least almost closed, of the contact frame 4, the stripped end 6 of the electrical conductor 5 being held between the side walls of the channel-shaped contact frame 4 which are designed as leaf springs 9. The leaf springs 9 are here bent out of a flat material and their free ends form a clamping edge 10 so that the two opposite clamping edges 10 of the leaf springs 9 form a clamping point for the electrical conductor 5. The region from the channel entrance 8 of the contact frame 4 which adjoins the conductor introduction opening 3 as far as the clamping point formed by the clamping edges 10 here defines a conductor introduction region 30.

Figure 3:
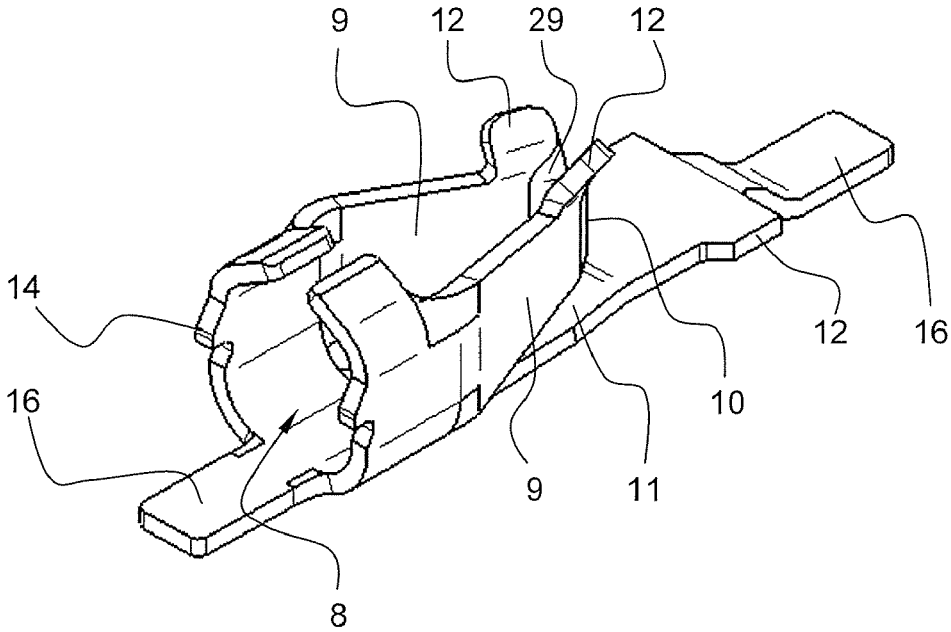
FIG. 3 shows a perspective view of the contact frame.

The structure of the contact frame 4 can be clearly seen in FIG. 3, where it can be seen that, in order to form the clamping edge 10, an additional flared-out part directed toward the electrical conductor 5 is stamped or integrally formed on the free end of the leaf spring 9, in order to improve the clamping effect. The contact frame 4 moreover has a contact base 11 which is turned or bent out of the surface of a plane metal part in such a way that the latter is inclined from the channel entrance 8 in the direction of the clamping point, and so essentially in the conductor introduction region 30, with an inclination which increases in the direction of a plugged-in conductor 5. The contact base 11 is adjoined at one end, at the channel entrance 8, by a first contact region 16 and at the other end by a second contact region 16. In addition, front catch hooks 14 integrally formed on the annular channel entrance 8 can be seen in FIG. 3 which engage, in order to effect a locking connection with the housing 2 made of insulating material, in corresponding front catch recesses 17 arranged there next to the conductor introduction opening 3. In the region between the clamping point formed by the clamping edges 10 and the rear contact region 16 remote from the annular channel entrance, rear catch hooks 15 arranged at the sides of the contact base 11 are provided on the contact base 11, are preferably spaced apart from the printed circuit board (7) or the plane formed by the contact regions 16, and engage in catch recesses, not shown, of the housing 2 made of insulating material.

In the region of the free end of the leaf springs 9, on which the clamping edge 10 is in each case formed, the leaf spring 9 has in each case on its longitudinal side remote from the contact base 10 a lead-in sloping face 12 which is directed in each case toward the outside of the connection terminal 1. The lead-in sloping faces 12 of a contact frame 4 thus together form an upwardly directed funnel-shaped receptacle remote from the contact base 10.

Figure 5A:
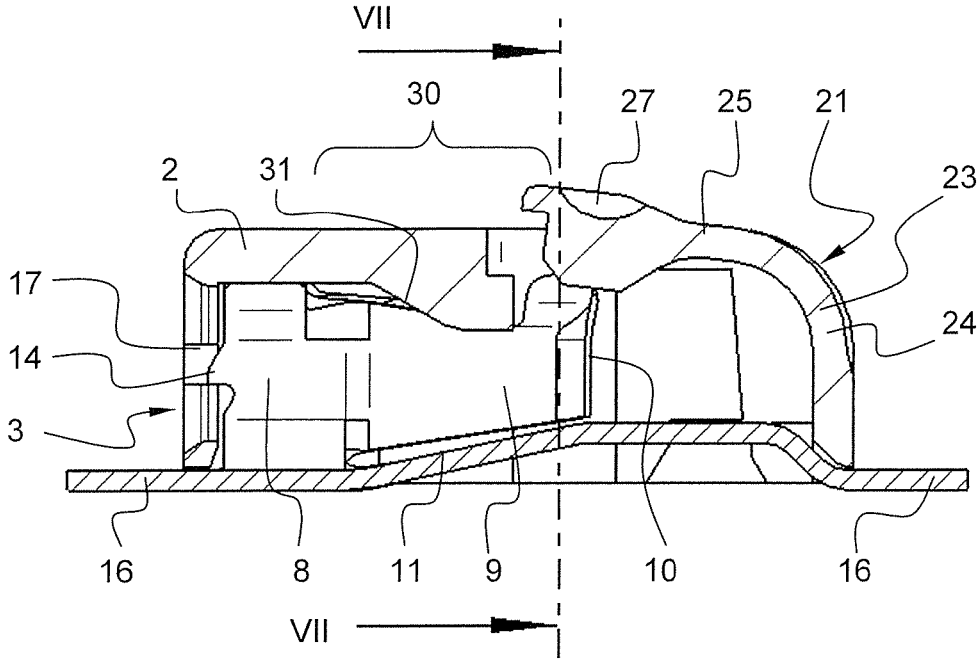
FIG. 5*a* shows a cross-sectional view of the connection terminal according to the invention corresponding to the section IV-IV in FIG. 1 with the pusher unactuated.
Figure 5B:
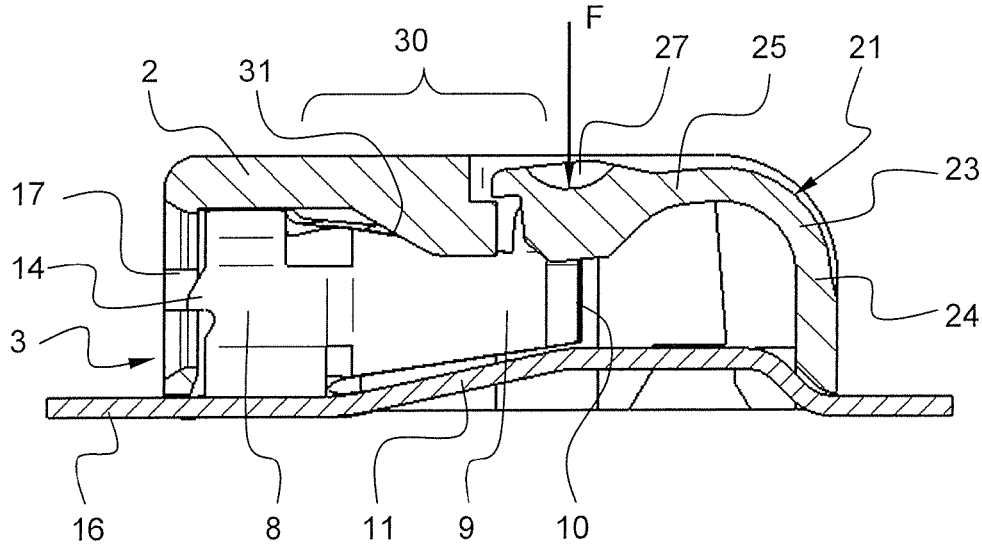
FIG. 5*b* shows a cross-sectional view of the connection terminal according to the invention corresponding to the section IV-IV in FIG. 1 with the pusher actuated.

FIGS. 4, 5*a* and 5*b* each show a cross-sectional view of the electrical connection terminal 1 according to the invention assembled from a contact frame 4 and a housing 2 made of insulating material, an attached electrical conductor 5 additionally being shown in FIG. 4. It can be seen in these Figures that the inner wall 31 of the housing has a sloping region within which the inner wall 31 of the housing is designed such that it is inclined against a plugged-in conductor 5. This inclined region lies within the above-defined conductor introduction region 30 or can also extend over the entire conductor introduction region 30.

It can also be seen in these drawings that the conductor introduction region 30 can, owing to the configuration of the contact frame 4 with its leaf springs 9 and its contact base 10 and of the inner wall 31 of the housing 2 made of insulating material, at least in portions have a funnel-shaped design, it being clear that the funnel-shaped conductor introduction region 30 is assembled from the contact frame 4 and the housing 2 made of insulating material. The funnel-shaped conductor introduction region 30 is here at least almost completely closed at the periphery. Narrow gaps are present only between the leaf springs 9 and the contact base 10, on the one hand, and the leaf springs 9 and the inner wall 31 of the housing, on the other hand. In the exemplary embodiment, the cross section of the conductor introduction region 30 is essentially rectangular or square in design, but it can also have any other desired shape and in particular be round, or round at least in portions, or curved.

The funnel-shaped conductor introduction region 30 here forms a guide for the electrical conductor 5 which is to be plugged in, in particular for its stripped end 6, so that the stripped end 6 can be brought to the clamping point in a targeted fashion. The electrical connection terminal 1 can also be used for multiple-wire electrical conductors 5, in particular when the clamping point formed by the clamping edges 10 is opened, before the electrical conductor 5 is plugged in, by an actuating element which takes the form of a pusher 21. The individual wires of the multiple-wire conductor 5 are unable to be diverted owing to the conductor introduction region 30 that is almost completely closed at the periphery, and are securely held in clamping fashion by the clamping edge 10. The end of the funnel-shaped portion of the conductor introduction region 30 which faces the conductor introduction opening 3, with the larger cross section, can here also serve, when desired, as a stop for the insulated portion of the electrical conductor 5.

Because the funnel-shaped conductor introduction region 30 is assembled from the housing 2 made of insulating material and the contact frame 4 or is formed by these two components, simple and effective guidance of the conductor is obtained, it being possible in particular for the contact frame 4 to be designed in a very simple and compact manner which saves on material.

A pusher 21 which acts as an actuating element can also be seen in FIGS. 4, 5*a* and 5*b*, with a pusher arm 23 which is designed integrally with the housing 2 made of insulating material. The pusher 21 here acts on lead-in sloping faces 12 and when actuated pushes apart these lead-in sloping faces 12 together with the leaf springs 9, i.e. when pushed in with a force F in the direction of the housing 2 made of insulating material. The clamping edges 10 of the leaf springs 9 are thus also pushed apart, and the clamping point is opened to remove an electrical conductor 5 or to plug in an electrical conductor 5, in particular a multiple-wire conductor 5.

Figure 6A:
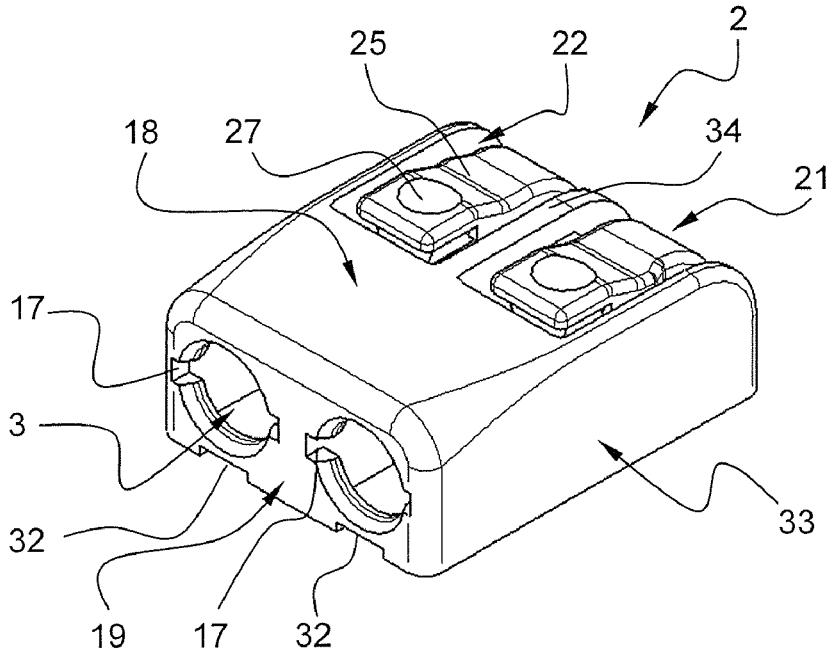
FIG. 6*a* shows a first perspective view of the housing made of insulating material.
Figure 6B:
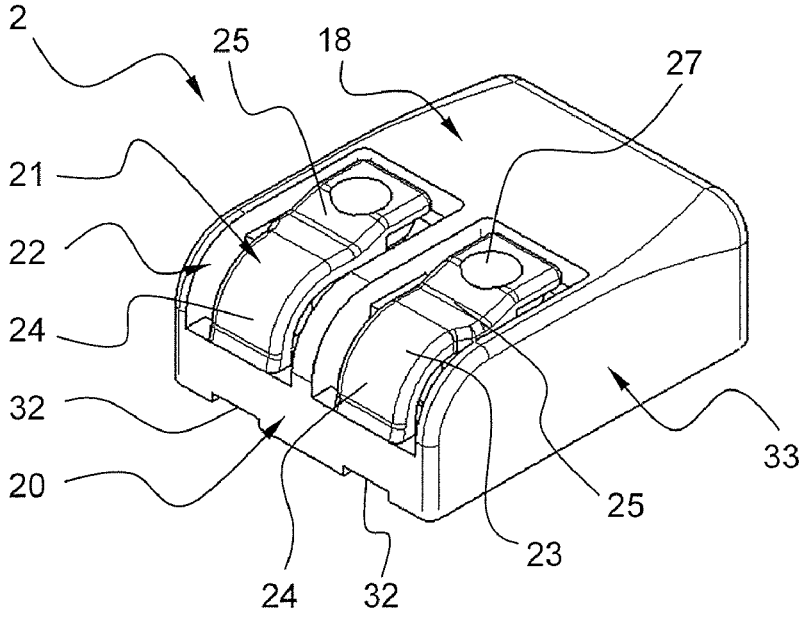
FIG. 6*b* shows a second perspective view of the housing made of insulating material.

In accordance with the view in FIGS. 6*a* and 6*b*, the pusher arm 23 is integrally formed in one piece on the housing 2 made of insulating material in the region of the rear side 20 of the housing, preferably in its lower half remote from the upper side 18 of the housing. The pusher arm 23 thus follows the contour of the housing 2 made of insulating material so that a first pusher arm part 24 connected to the rear wall 20 of the housing extends approximately in the plane of the rear side 20 of the housing or approximately parallel hereto. The contour of the pusher arm 23 follows, in the continuation of its course, the contour of the transition from the rear side 20 of the housing to the upper side 18 of the housing, so that a second pusher arm part 25 which is connected to the first pusher arm part 24 in one piece is approximately in the plane of the upper side 18 of the housing or extends approximately parallel hereto. The rear side 20 of the housing and the upper side 18 of the housing are here arranged at an angle to each other, and the rear side 20 of the housing and the upper side 18 of the housing are preferably arranged at least almost at right angles to each other. The pusher arm 23 thus essentially takes the form of an angle. An actuating surface 27 is integrally formed on the second pusher arm part 25 at its end remote from the first pusher arm part and in the present exemplary embodiment has a trough-like design but can alternatively also have any other desired shape, for example take the form of a slot or crossed slot. It can thus be seen that the pusher 21 is arranged in a housing recess 22 which extends over the rear side 20 of the housing and the upper side 18 of the housing. The housing recess 22 is thus essentially configured as an aperture so that the pusher 21 can act on the contact frame 4 arranged inside the housing 2 made of insulating material. The pusher 21 which acts as an actuating element is thus integrated with its angled design into the wall or upper surface of the housing 2 made of insulating material and represents a part of the housing 2 made of insulating material itself.

In the unmounted state, the pusher arm 23 or the outer upper surface is situated essentially in the plane of the contour of the upper surface of the housing 2 made of insulating material, both in the region of the upper side 18 of the housing and in the region of the rear side 20 of the housing. In contrast, in the mounted state with the contact frame 4 inserted in the housing 2 made of insulating material and the unactuated state, the pusher 21 projects somewhat at least relative to the upper side 18 of the housing, as can be seen in FIG. 5*a*. The lead-in sloping faces 12 of the contact frame 4 here rest on the pusher 21, or to be more precise on its pusher surface 26 (FIG. 7), and deflect the pusher 21 outwards so that the pusher arm 23 is subject to elastic pretensioning. The actuated state is shown in FIG. 5*b*, in which an actuating force F is applied to the pusher 21 in the region of the trough-like actuating surface 27. It can be seen that the pusher arm 23 is deformed resiliently and essentially uniformly under the actuating force F, the region of the pusher 21 dipping between the leaf springs 9 with the actuating surfaces 26. For uniform resilient deformation, the pusher arm 23 has an essentially uniform thickness. During the actuating process, i.e. when the pusher 21 is pushed in, the pusher 21 is displaced from the position projecting above the upper side 18 of the housing into a position in which the pusher arm 23, in particular the second pusher arm part 25, dips into the housing 2 made of insulating material. The resilient pretensioning of the pusher arm 23 is thereby increased and the pusher arm 23 is subject to a reverse tensioning so that the pusher arm tends to move outwards again in order to reach its initial position.

FIGS. 6*a* and 6*b* illustrate the housing 2 made of insulating material as a single part, where in particular the described design of the pusher 21 and the connection of the pusher arm 23 to the housing 2 made of insulating material can again be clearly seen. It can also be seen that the housing 2 made of insulating material has, on an underside of the housing, in each case recesses 32 into which the contact regions 16 of the contact frame 4 engage so that these contact regions 16 can project above the rear side 20 of the housing and the front side 19 of the housing with the conductor introduction openings 3 (see also FIG. 1). At the same time, it is obtained that the underside of the housing of the assembled electrical connection terminals forms an essentially flat surface with no projecting components. The housing 2 made of insulating material can thus, when arranged on the printed circuit board 7, extend directly as far as the upper surface of the printed circuit board 7 and rest on the printed circuit board 7.

FIG. 7 again illustrates how the pusher 21 acts on the contact frame 4. The pusher surface 26 of the pusher 21 is essentially wedge-shaped in design and acts on the corresponding obliquely positioned lead-in sloping faces 12 of the contact frame 4. When a force F is applied to the pusher 21 via the actuating surface 27, the wedge-shaped pusher surface 26 slides over the lead-in sloping faces 12, and so dips between the leaf springs 9 and pushes them apart. As soon as the actuating force F is removed from the pusher 21, the leaf springs 9 push the pusher 21, by virtue of their restoring force, over the lead-in sloping faces 12 and the actuating surface 26 corresponding thereto back again into the initial position.

The illustrated angular design of the pusher 21 enables a relatively long effective pusher arm 23 with a correspondingly long lever arm, which is advantageous in particular when space is limited or in the case of small electrical connection terminals with small housings made of insulating material. Thus, in particular in the case of miniaturized connection terminals, it is only made possible by the design of the pusher 21 according to the invention to provide an effective pusher 21 for actuating a contact frame 4.

Because the pusher arm 23 is subject to pretensioning in the unactuated state, the tension which is applied to the pusher arm 23 can be kept small. The value of the pretensioning is relatively small as the deflection of the pusher arm 23 in the unactuated state is also relatively small. The deflection of the pusher arm 23 in the actuated position into the housing 2 made of insulating material is also not significantly much greater than in the unactuated state, so that the tensions to which the pusher arm 23 is subject can overall be kept small. If, in contrast, the whole actuation travel takes place on an untensioned pusher arm 23, the tension acting on the pusher arm 23 would be considerably greater so that the pusher arm 23 as a whole would have to have larger dimensions. It can therefore be seen that, with the present arrangement of the pusher 21 inside the connection terminal 1 and its interaction with the contact frame 4, the pusher 21 as a whole can be kept very small and thus is suited in particular for connection terminals which need to be very small in construction.

Figure 7:
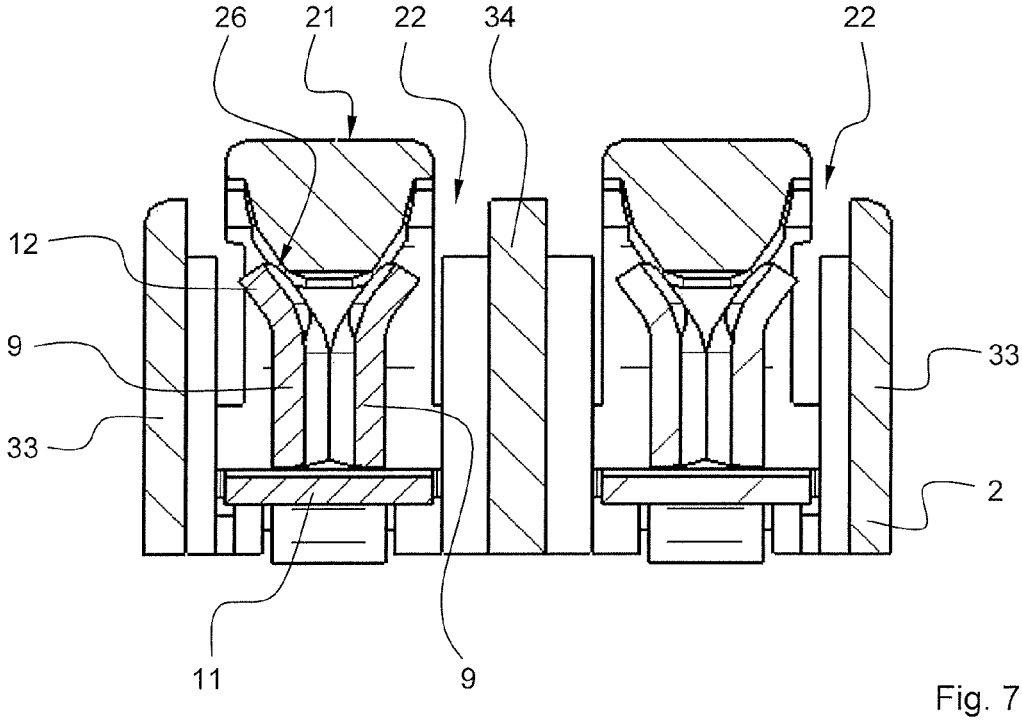
FIG. 7 shows a cross-sectional view of the connection terminal according to the invention corresponding to the section VII-VII in FIG. 5*a*.

With the illustrated design of the electrical terminal, an overload protection for both the leaf springs 9 and the pusher 21 can also be achieved. As can be seen in FIG. 7, the lead-in sloping faces 12 arranged on the leaf springs 9 will, when there is a sufficient deflection of the leaf springs 9, abut the side walls 33 of the housing 2 made of insulating material and/or one or more partition walls 34 of the housing 2 made of insulating material which are arranged between the poles of the connection terminal 1. The side walls 33 and/or partition walls 34 thus limit deflection of the leaf springs 9 and prevent the latter from being overloaded and thus being plastically deformed or breaking.

At the same time, however, it is possible to provide an overload protection for the pusher (21) and the pusher arm. Because of the limited deflection of the leaf springs 9, only a limited gap can occur between two leaf springs associated with each other. As soon as the maximum width of the portion of the pusher arm 23 which dips between the leaf springs 9 is greater than the gap between the leaf springs 9 at their maximum deflection, the pusher arm 23 can only be deflected to a limited degree so that it also cannot be subjected to any excessive loading and fracturing of the pusher arm 23 is effectively avoided.

An overload protection for the pusher 21 and its pusher arm 23 can also be obtained by a stop being provided on that portion of the pusher arm 23 which dips between the leaf springs 9, said stop resting against the leaf springs 9 or the lead-in sloping faces 12 at the maximum deflection of the pusher arm or at a maximum dipping depth, so that further deflection of the pusher arm is prevented and damage to the pusher 21 avoided.

LIST OF REFERENCE NUMERALS

1 connection terminal
2 housing made of insulating material
3 conductor introduction opening
4 contact frame
5 electrical conductor
6 stripped end of the electrical conductor
7 printed circuit board
8 channel entrance
9 leaf springs
10 clamping edge
11 contact base
12 lead-in sloping faces
13 flaring of the free end of the leaf spring
14 front catch hook
15 rear catch hook
16 contact regions
17 front catch recess
18 upper side of the housing
19 end side
20 rear side of the housing
21 pusher
22 housing recess
23 pusher arm
24 first pusher arm part
25 second pusher arm part
26 pusher surface
27 actuating surface
28 conductor track, contact portion
30 conductor introduction region
31 inner wall of the housing
32 recess
33 side wall
34 partition wall

The invention claimed is:

1. Actuating device for an electrical connection terminal, wherein the electrical connection terminal comprises a contact frame, arranged in a housing made of insulating material, with a conductor terminal connection for an electrical conductor, the actuating device comprises an actuating element in the form of a pusher which is integrally formed with the housing made of insulating material so that the pusher and the housing forms a single piece, the conductor terminal connection is formed on the contact frame by at least one spring element, the free end of which forms a clamping edge which is directed toward the electrical conductor and to which a clamping force is applied, and the conductor terminal connection can be opened by action of the pusher on the at least one spring element by a force being applied to the spring element by the pusher counter to the clamping force, wherein the pusher consists of a pusher arm, wherein the pusher arm is connected with one of its ends to the housing made of insulating material, and wherein the pusher arm extends along at least a partial section of two surfaces of the housing made of insulating material which are arranged at an angle to each other.

2. Actuating device according to claim 1, wherein the two surfaces which are arranged at an angle to each other are arranged at least almost perpendicularly to each other.

3. Actuating device according to claim 1, wherein the pusher arm has an actuating surface with a trough-like recess.

4. Actuating device according to claim 1, wherein the pusher arm can be deformed resiliently.

5. Actuating device according to claim 1, wherein the spring element takes the form of a leaf spring or a spring leg.

6. Actuating device according to claim 1, wherein the contact frame is configured as a channel and wherein the contact frame has on each side wall, in order to form a conductor terminal connection, in each case at least one leaf spring, in the form of a tongue stamped from a flat material, which is bent out of the plane of the flat material, in such a way that the free end of the leaf spring forms a clamping edge directed toward the electrical conductor.

7. Actuating device according to claim 6, wherein a lead-in sloping face directed toward the outside of the electrical connection terminal is in each case integrally formed on the leaf springs.

8. Actuating device according to claim 1, wherein an overload protection is provided for the at least one spring element and/or the pusher.

9. Actuating device according to claim 8, wherein the deflection of the spring element in the form of a leaf spring can be limited by side walls and/or partition walls of the housing made of insulating material.

10. Actuating device according to claim 8, wherein the deflection of the pusher arm can be limited by the pusher arm bearing against at least one spring element in the form of a leaf spring.

11. Actuating device for an electrical connection terminal, wherein the electrical connection terminal comprises a contact frame, arranged in a housing made of insulating material, with a conductor terminal connection for an electrical conductor, the actuating device comprises an actuating element in the form of a pusher which is integrally formed with the housing made of insulating material so that the pusher and the housing forms a single piece, the conductor terminal connection is formed on the contact frame by at least one spring element, the free end of which forms a clamping edge which is directed toward the electrical conductor and to which a clamping force is applied, and the conductor terminal connection can be opened by action of the pusher on the at least one spring element by a force being applied to the spring element by the pusher counter to the clamping force, wherein the pusher consists of a pusher arm, wherein the pusher arm is connected with one of its ends to the housing made of insulating material, and wherein the pusher arm extends along at least a partial section of two surfaces of the housing made of insulating material which are arranged at an angle to each other, and wherein the pusher arm has an actuating portion which is remote from the end connected to the housing made from insulating material and which has an essentially wedge-shaped pusher surface, wherein the wedge-shaped pusher surface can be pushed in between the leaf springs by the lead-in sloping faces flared out relative to each other in a funnel shape in order to open the terminal connection of the electrical conductor by the leaf springs being pushed apart.

12. Actuating device for an electrical connection terminal, wherein the electrical connection terminal comprises a contact frame, arranged in a housing made of insulating material, with a conductor terminal connection for an electrical conductor, the actuating device comprises an actuating element in the form of a pusher which is integrally formed with the housing made of insulating material so that the pusher and the housing forms a single piece, the conductor terminal connection is formed on the contact frame by at least one spring element, the free end of which fauns a clamping edge which is directed toward the electrical conductor and to which a clamping force is applied, and the conductor terminal connection can be opened by action of the pusher on the at least one spring element by a force being applied to the spring element by the pusher counter to the clamping force, wherein the pusher consists of a pusher arm, wherein the pusher arm is connected with one of its ends to the housing made of insulating material, and wherein the pusher arm extends along at least a partial section of two surfaces of the housing made of insulating material which are arranged at an angle to each other, wherein the pusher arm is formed by a first pusher arm part which matches the course of a rear side of the housing, and a second pusher arm part which matches the course of an upper surface of the housing, wherein the pusher arm is arranged inside a recess of the housing made from insulating material, and wherein, in the mounted state of the housing made from an insulating material and the contact frame, the pusher arm is subject to pretensioning.

* * * * *